US009068718B2

(12) United States Patent
Pierceall et al.

(10) Patent No.: US 9,068,718 B2
(45) Date of Patent: Jun. 30, 2015

(54) INDIRECT EXCITATION OF PHOTOREACTIVE MATERIALS COATED ON A SUBSTRATE WITH SPECTRUM SIMULATION

(71) Applicant: Production Resource Group, LLC, Armonk, NY (US)

(72) Inventors: Richard Pierceall, El Granada, CA (US); Ian Clarke, Dallas, TX (US)

(73) Assignee: Production Resource Group, LLC, New Windsor, NY (US)

( * ) Notice: Subject to any disclaimer, the term of this patent is extended or adjusted under 35 U.S.C. 154(b) by 184 days.

(21) Appl. No.: 13/672,936

(22) Filed: Nov. 9, 2012

(65) Prior Publication Data

US 2013/0208443 A1 Aug. 15, 2013

Related U.S. Application Data

(60) Provisional application No. 61/597,798, filed on Feb. 12, 2012, provisional application No. 61/635,777, filed on Apr. 19, 2012.

(51) Int. Cl.

| | |
|---|---|
| ***F21V 9/16*** | (2006.01) |
| ***F21V 9/08*** | (2006.01) |
| ***H05B 33/08*** | (2006.01) |
| ***F21V 3/04*** | (2006.01) |
| *F21V 29/00* | (2015.01) |
| *F21S 6/00* | (2006.01) |
| *F21V 15/01* | (2006.01) |
| *F21V 17/00* | (2006.01) |
| *F21V 21/30* | (2006.01) |
| *F21V 23/04* | (2006.01) |
| *F21W 131/406* | (2006.01) |

(Continued)

(52) U.S. Cl.

CPC ... *F21V 9/16* (2013.01); *F21V 9/08* (2013.01); *F21V 29/2206* (2013.01); *F21S 6/005* (2013.01); *F21V 15/011* (2013.01); *F21V 17/002* (2013.01); *F21V 21/30* (2013.01); *F21V 23/04* (2013.01); *H05B 33/0803* (2013.01); *F21W 2131/406* (2013.01); *F21Y 2101/02* (2013.01); *F21Y 2113/005* (2013.01); *F21V 3/0481* (2013.01)

(58) Field of Classification Search

CPC ..... F21V 3/0481; F21V 9/16; F21V 9/08; F21V 29/2206; F21V 15/011; F21V 17/002; F21V 21/30; F21V 23/04; H05B 33/0803; F21S 6/005; F21W 2131/406; F21Y 2101/02; F21Y 2113/005

USPC ..... 362/16–18, 84, 232, 277, 280, 281, 362/319, 323

See application file for complete search history.

(56) References Cited

U.S. PATENT DOCUMENTS 2,273,316 A * 2/1942 Goerg et al. ..... 362/281
3,868,501 A * 2/1975 Barbour ..... 40/442

(Continued)

OTHER PUBLICATIONS

N.Narendran & L.Deng, "Color Rendering Properties of LED Light Sources", Society of Photo-Optical Instrumentation Engineers, 2002, 8 pages.*

(Continued)

*Primary Examiner* — Alan Cariaso

(74) *Attorney, Agent, or Firm* — Law Office of Scott C. Harris, Inc.

(57) ABSTRACT

A remote phosphor light which simulates the spectrum of a specified real world light, e.g. a tungsten or a daylight bulb.

20 Claims, 15 Drawing Sheets

(51) Int. Cl.
*F21Y 101/02* (2006.01)
*F21Y 113/00* (2006.01)

(56) References Cited

U.S. PATENT DOCUMENTS 6,357,889 B1 * 3/2002 Duggal et al. ..... 362/84
7,168,833 B2 * 1/2007 Schottland et al. ..... 362/510
7,405,715 B2 * 7/2008 Guzman et al. ..... 345/83
7,744,242 B2 * 6/2010 Kramer ..... 362/231
7,810,954 B2 * 10/2010 Kolodin ..... 362/277
8,297,783 B2 * 10/2012 Kim ..... 362/231
8,459,814 B2 * 6/2013 Su et al. ..... 362/84
2005/0135079 A1 * 6/2005 Yin Chua et al. ..... 362/12
2010/0295077 A1 11/2010 Melman

OTHER PUBLICATIONS

Novel Remote Phosphor Architectures and Methods for Modeling Performance, May 17, 2011.

* cited by examiner

| CRI Measurement | R1 | R2 | R3 | R4 | R5 | R6 | R7 | R8 | R9 | R10 | R11 | R12 | R13 | R14 | CRI | CRI Extended |
|---|---|---|---|---|---|---|---|---|---|---|---|---|---|---|---|---|
| TruColor HS 3200K | 99 | 97 | 90 | 92 | 98 | 95 | 93 | 94 | 95 | 91 | 92 | 89 | 99 | 94 | 96 | 95 |
| TruColor HS 5200K | 93 | 90 | 88 | 90 | 93 | 88 | 90 | 92 | 83 | 78 | 91 | 74 | 92 | 92 | 90 | 88 |

FIG. 3A

| | R0 | R1 | R2 | R3 | R4 | R5 | R6 | R7 | R8 | R9 | R10 | R11 | R12 | R13 | R14 | R15 |
|---|---|---|---|---|---|---|---|---|---|---|---|---|---|---|---|---|
| Typical Tungsten Source | 98 | 99 | 99 | 100 | 99 | 98 | 98 | 100 | 99 | 98 | 98 | 99 | 97 | 99 | 100 | 99 |
| TruColor FOTON | 96 | 97 | 99 | 97 | 97 | 98 | 98 | 100 | 99 | 99 | 100 | 96 | 91 | 98 | 97 | 98 |

FIG. 4A

INDIRECT EXCITATION OF PHOTOREACTIVE MATERIALS COATED ON A SUBSTRATE WITH SPECTRUM SIMULATION

This application claims priority from provisional application No. 61/597,798 filed Feb. 12, 2012, and from 61/635,777 filed Apr. 19, 2012, the entire contents of which are herewith incorporated by reference.

BACKGROUND

Different kinds of light sources are used to create different kinds of effects. For example, tungsten based light sources create light that has a correlated color temperature (CCT) in the 3200 K range. This is seen by users with a yellowish tint to the light. Natural daylight, with a CCT of 5200K, has a blue look. Natural light can be created using different kinds of sources.

Human eyes generally correct for the different looks of different light sources. However when used for stage or photography work, the camera sees the different light colors and reacts differently to the different colors.

Use of LED lights typically creates spikes of each of red, green, and blue colors. The camera optics react to those outputs. This can create undesired effects, such as the color of objects shifting in hue when used in camera work.

SUMMARY

An embodiment describes a remote phosphor light system which simulates a desired spectrum of light.

Aspects include a housing that provides special characteristics for the light, and also include other aspects.

According to one embodiment, the coatings that are used produce outputs that simulate the output of a specified kind of conventional "analog" light. For example, one coating formulation will simulate the operation of or the light output of a tungsten light. Another lighting output will simulate the operation of a daylight light. This is done by selecting different colors within the conventional color rendering index, and attempting to make each of these colors as close as possible to the color that would be produced by the conventional light source. Aspects of the invention include, simulating in one embodiment, the spectrum created by a tungsten light source (referred to herein as "lamp") or the spectrum created by a daylight lamp. The simulation is carried out using a phosphor device that is remote from the light source.

In one embodiment, the phosphor may be specially formulated to have certain characteristics.

Special packaging of these items, and heat dissipation characteristics for this kind of device, are disclosed.

BRIEF DESCRIPTION OF THE DRAWINGS

The figures show aspects of the invention.

Specifically:

FIGS. 4A and 4B show comparison between the lamp of an embodiment and an real life tungsten bulb;

DETAILED DESCRIPTION

Figure 1A:
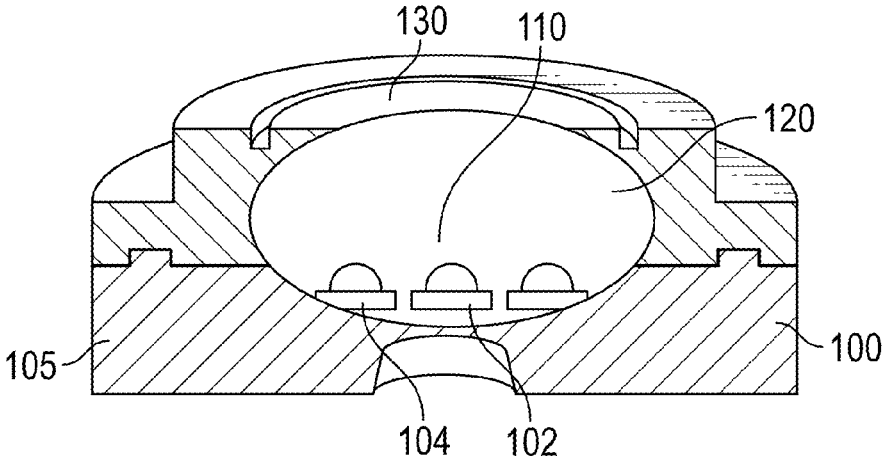
FIG. 1A shows a diagram of the different parts according to a first embodiment.

The inventors recognize the challenge of developing digital lighting technologies that approach the color rendering quality of a black-body radiator, such as a tungsten filament. Typical LED sources have inherently discontinuous light spectra. This creates color rendering issues for certain aspects, especially for film emulsions and digital camera sensors.

Another recognition, however, is that the light of the conventional "analog" lamp or light bulb actually has a spectrum with different components that extend across various parts of the color spectrum. For example, while tungsten light has a CCT of 3200K, there are components of the tungsten bulb output that extend across different parts of the spectrum including different parts in blue, red and other parts of the spectrum.

The inventors recognize, however, that the output of the conventional analog tungsten bulb has a certain look that is created by these different color components. An embodiment describes technology which harnesses the Remote Phosphor (RP) technology, to deliver a nearly continuous, linear spectrum while eliminating nearly all of the other challenges associated with digital white light for image capture. According to embodiments, the remote phosphor is used to simulate the light output from an existing and conventional light source. One embodiment creates an output that is comparable to a 125 watt tungsten lamp, using 28 watt LEDs to excite a phosphor plate that is remote from the light source and where that phosphor plate uses phosphors that are intended to simulate the output from an existing analog light source. A light output simulates the light output of the tungsten lamp by creating light components that include all of the light components of the tungsten lamp.

FIGS. 1A-1G show a first embodiment of the light source and its packaging, where the light source of FIGS. 1A-1G is a cylindrically shaped light source that produces an output light that can be adjusted by a lensing system.

A group of LED light sources 100, 102, 104 direct light 110 into an optical mixing cavity 120, that is located between the light sources and a remote phosphor surface 130. The LEDs are mounted on a heat sink part 105 of the structure to absorb and manage the heat.

The photoreactive materials coated on a substrate can be a phosphoric material or any other photoreactive material now known or later created. The present application describes the use of a remote phosphor surface 130 uses a synthetic sapphire disk or other substrate onto which a very precise phosphor coating is applied as an embodiment. The phosphor coating can have the characteristics described herein. The phosphor coating is excited at one or two or some other number of precise wavelengths with LEDs 100, 102, 104 which are physically separated from the phosphor substrate 130. The result is very predictable, high CRI white light, or other color/type of light, depending on the characteristics of the phosphor that is used.

The phosphors are not subject to heat degradation as in typical white LEDs, so the color temperature of the light remains consistent throughout the lifetime of the fixture. Color consistency fixture-to-fixture can also be maintained, for example, by using a single batch of phosphor onto multiple different surfaces. The phosphor "recipe" itself can also be accurately maintained batch to batch.

An additional advantage of the use of the remote phosphor is that UV and IR emissions are virtually eliminated.

A constant-current driver circuit is used to drive the LEDs, and that driver can be dimmed 0-100% either locally or remotely on a phase or triac dimmer. The remote phosphor creates the same color for any illumination amount.

In one embodiment, a group of royal blue LEDs are used to create an excitation at 450 nm to excite the remote phosphor surface 130. In one embodiment, the remote phosphor creates a 3200 K output, characterized according to the CRI as described herein, with an overall CRI of 96 or above. The phosphor surface 130 can be changed to a different phosphor which is excited by the same LEDs, creating a 5200 K output with a CRI of 90. As described herein, the same fixture can have removable and replaceable phosphor substrates.

Figure 1B:
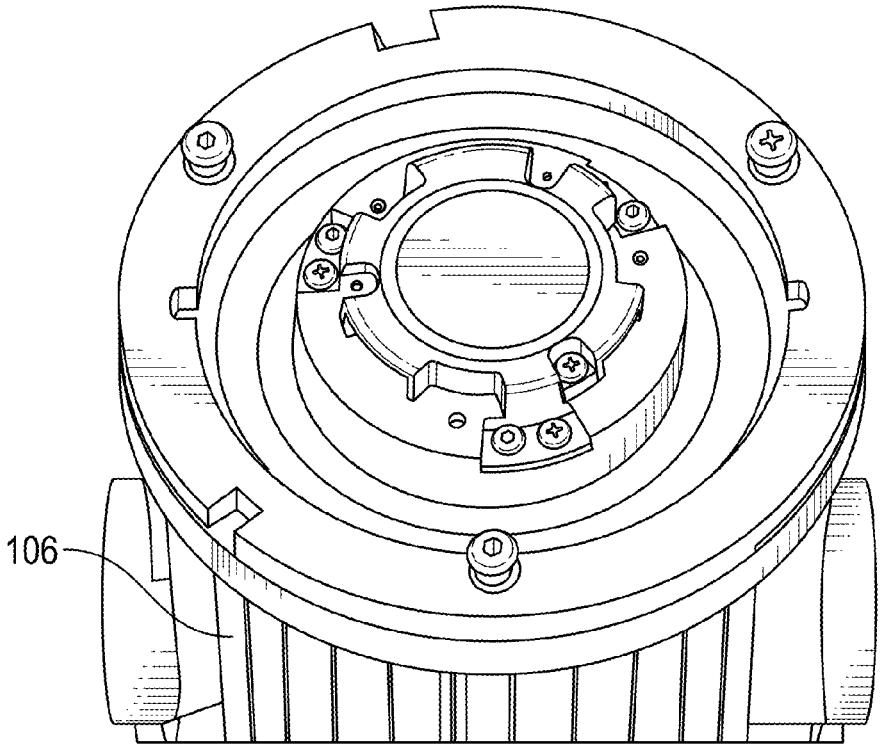
FIG. 1B shows an assembly drawing of an embodiment.

FIGS. 1A and 1B show the first package where multiple LEDs are packaged in a cylindrical housing, with heat dissipating fins 106 around the perimeter of the housing.

Figure 1C:
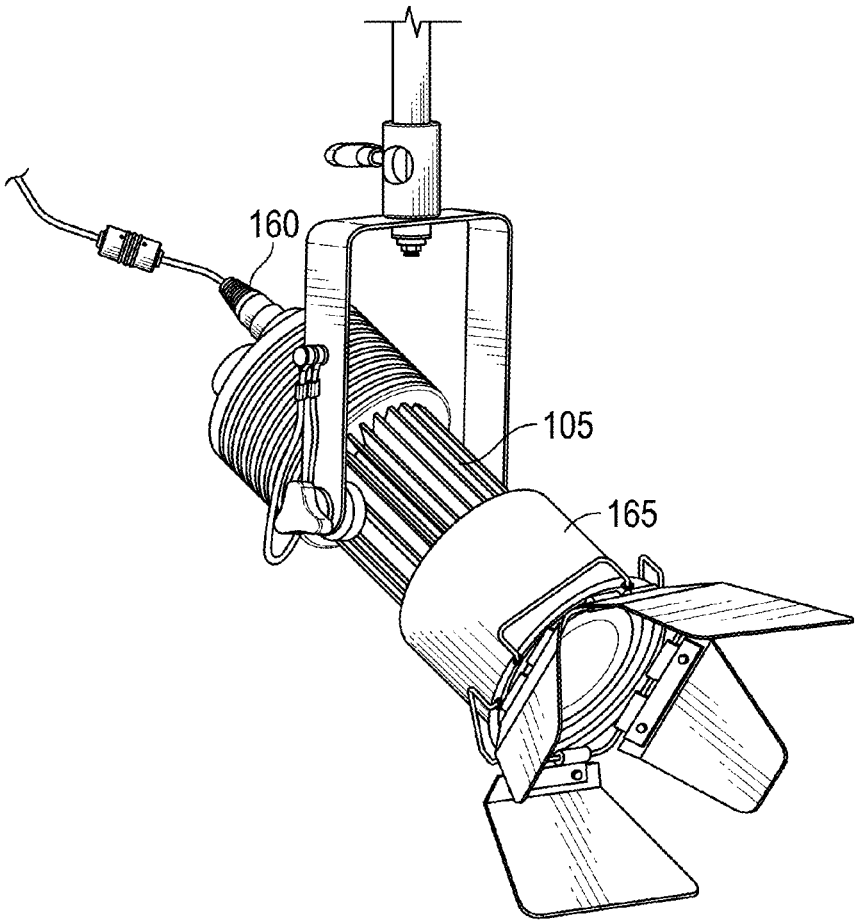
FIG. 1C shows a side view of the embodiment.

FIG. 1C shows a diagram of the FIG. 1 light, showing the power input 162 the rearmost section powering the LEDs, the heat sink section 105, inside of which is the optical mixing chamber, and also a lensing section 165 which includes lenses for focusing the light that is produced and projected.

Figure 1D:
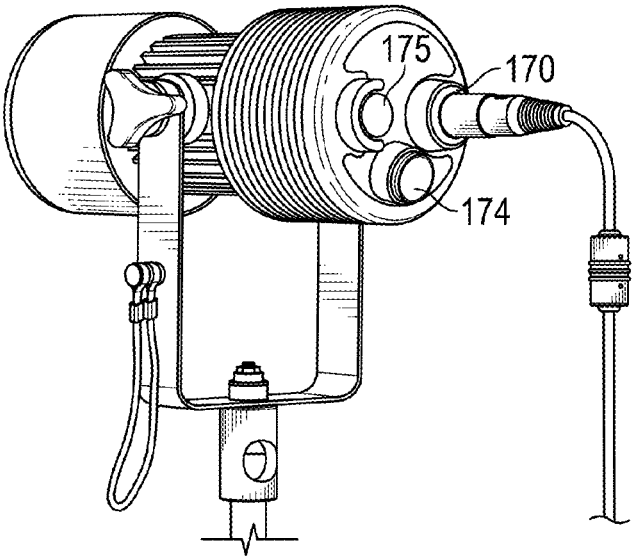
FIG. 1D shows a back view of the embodiment.
Figure 1E:
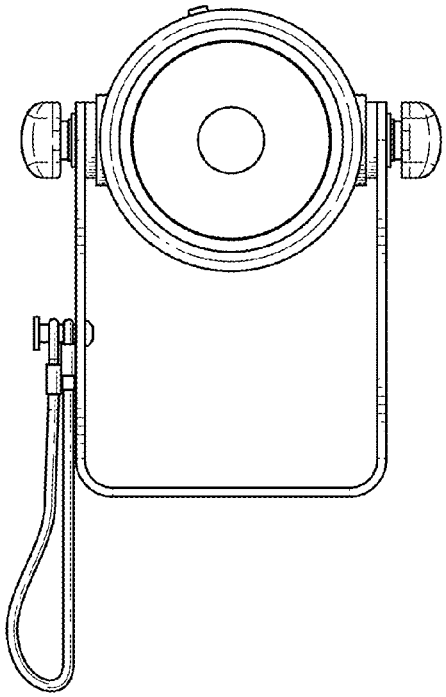
FIGS. 1E and 1F respectively show back view and side views of an assembly drawing.
Figure 1F:
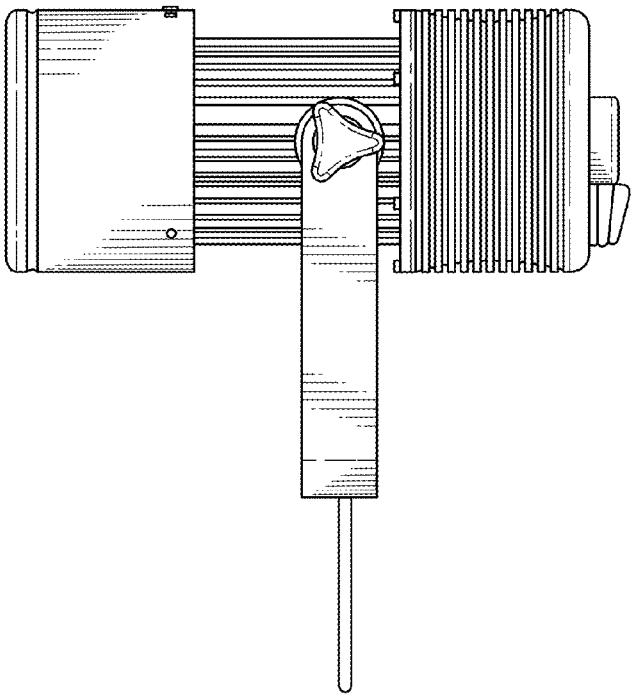

FIG. 1D shows the rear view of the light, showing how the rearmost section includes different connections and parts including power connector 170, a dimmer control 174, and an on-off switch 175. FIGS. 1E and 1F show respectively the assembly drawings of the different parts.

Figure 1G:
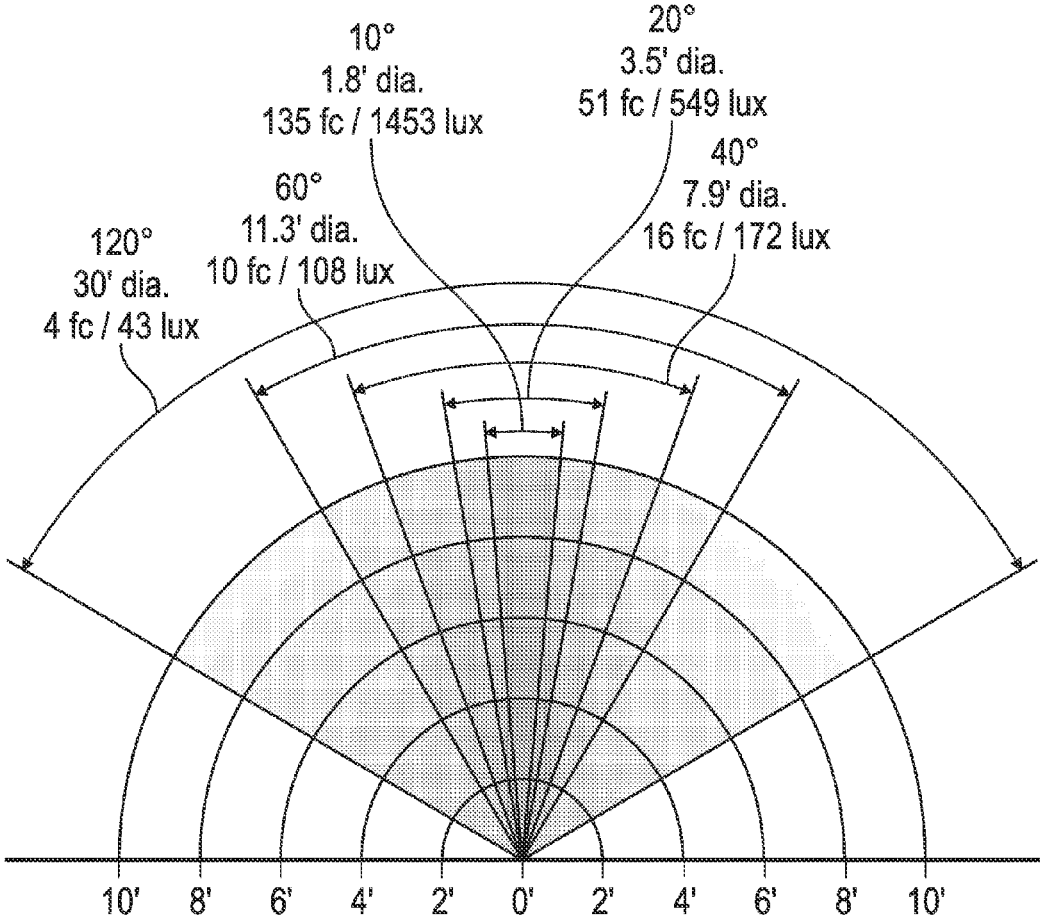
FIG. 1G shows the optical characteristics according to this embodiment at 10 feet.

FIG. 1G shows the luminous intensity of the output of this light simulating the tungsten output. As shown in FIG. 1G, the highest amount of illumination is found in the center in the center 10° of illumination which provides 1453 lx 135 footcandles for a 1.8 foot diameter at 10 feet from the source. FIG. 1G also shows the other illumination levels including 20°-51 footcandles; at 40° 16 footcandles, at 60° 10 footcandles and 4 footcandles at 120°.

Figure 2A:
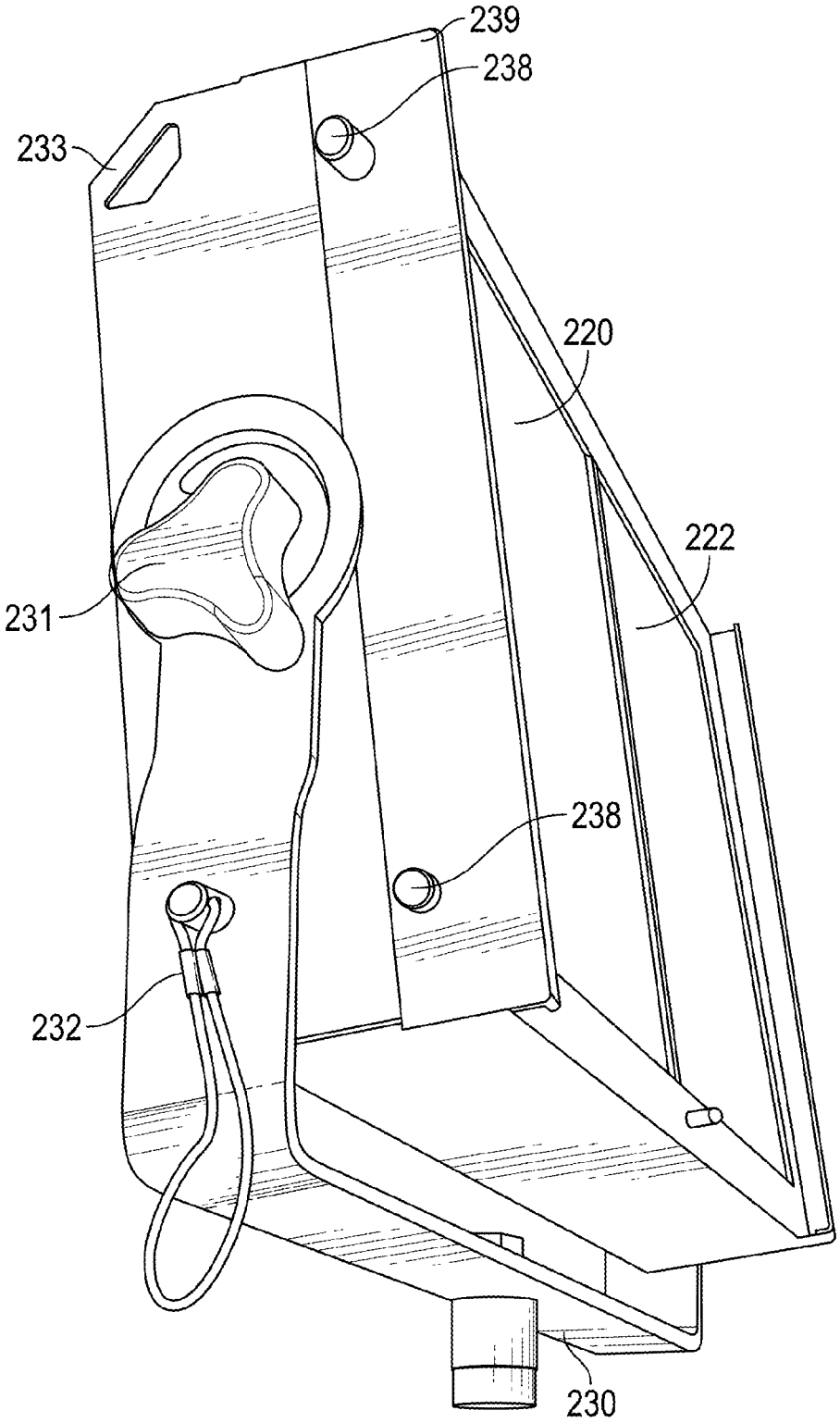
FIGS. 2A and 2B show a second embodiment of a panel light.
Figure 2B:
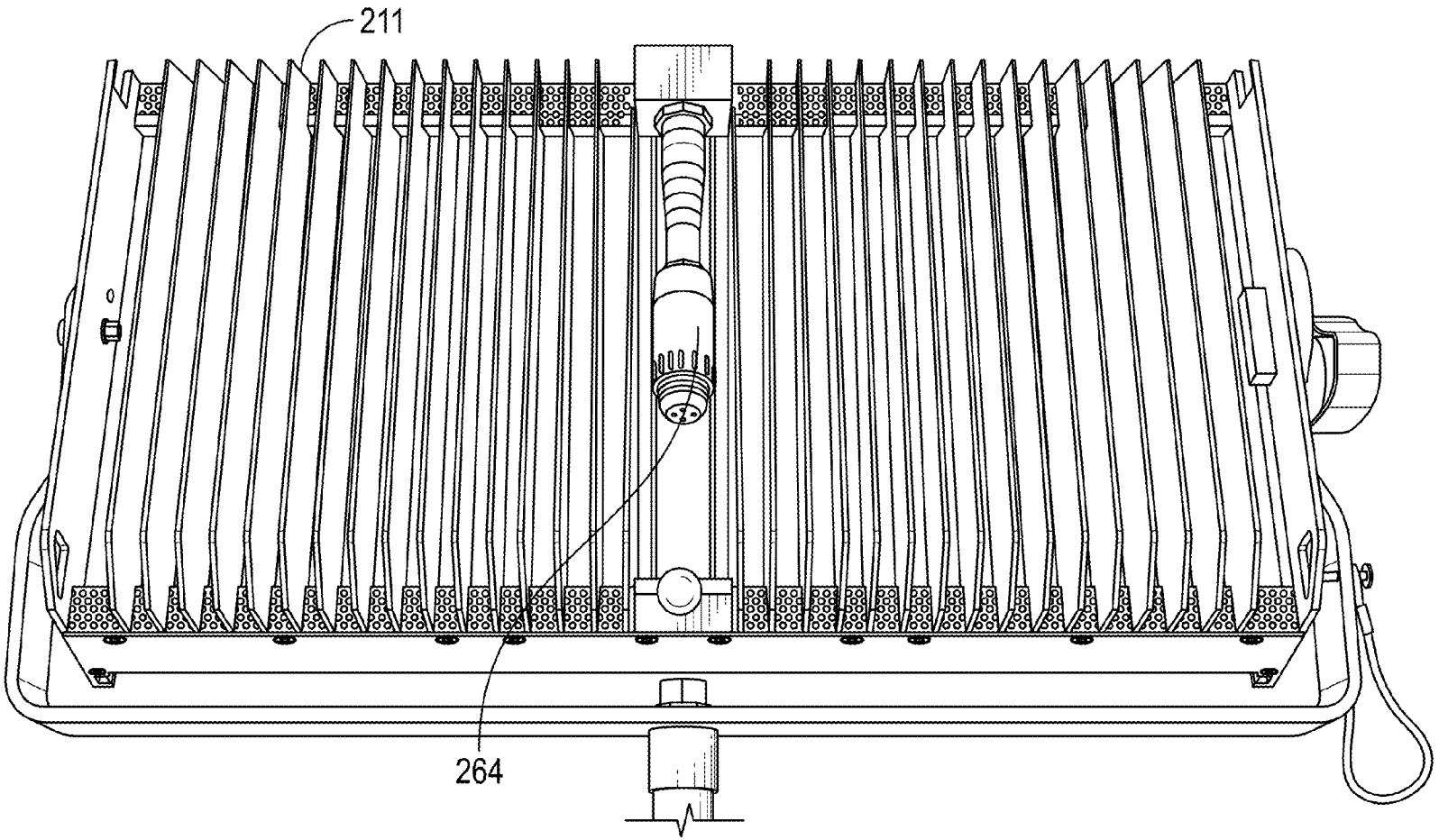

FIGS. 2A and 2B shows a second embodiment, showing a housing 200 that is rectangular in outer shape, FIG. 2A shows a front on view, and FIG. 2B shows a rear view. The housing 200 has slots for receiving the remote phosphor panels shown as 220 and 222. The rear portion 210 of the housing forms a surface for holding the LEDs 215, 216, for producing the illumination. FIG. 2C shows a side on view showing the surface 210 and the two LEDs 215, 216. It should be understood that any number of LEDs may be used in a similar way.

Heat dissipating fins 211 are also provided on the back of the housing and for dissipating heat created by the LEDs and by the optical mixing. An optical mixing chamber 1231 forms the space between the output of the LEDs 215 and the remote phosphor panels such as 220, 221 of the housing. The remote phosphor is excited by the light from the LEDs.

FIGS. 2A and 2B also show how the housing 200 is mountable on a stand, with an adjustment part 230. A retaining nut 231 may hold the device in place as it moves from place to place. The housing may also include a cable retainer 232, as well as a safety cable attachment point 233.

FIG. 2B illustrates how the rear portion of the housing includes a heat sink fins, and also a cable passing area 264 through which the cable passes to energize the light.

Either of these shaped housings, or any other housing shape or design, can be used with the other features described herein.

Figure 2D:
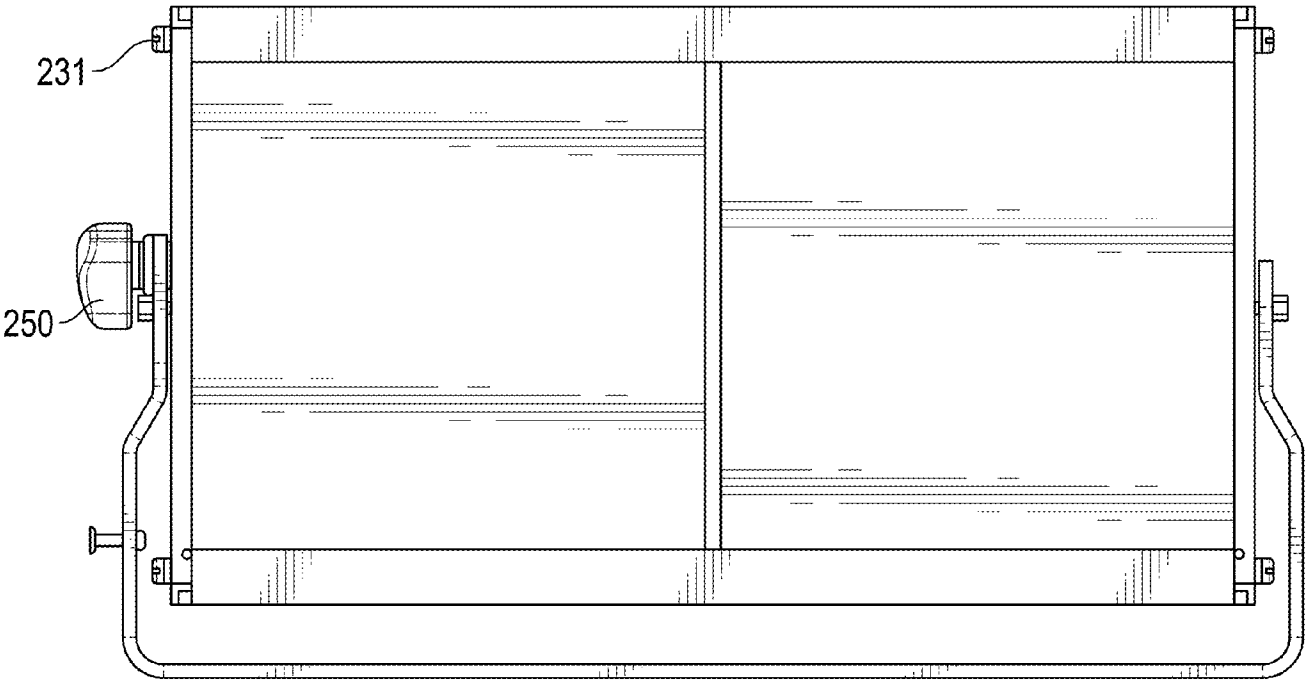
FIGS. 2C and 2D show assembly drawings of the panel light.
Figure 2C:
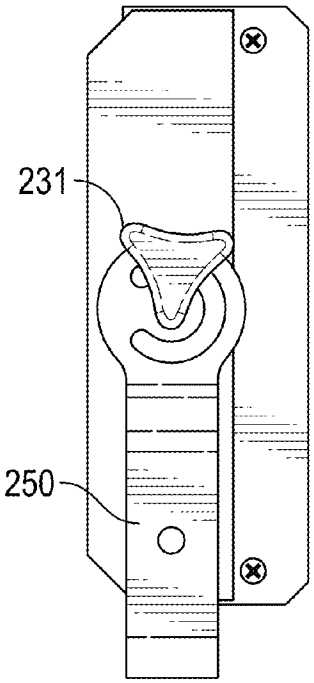
Figure 2E:
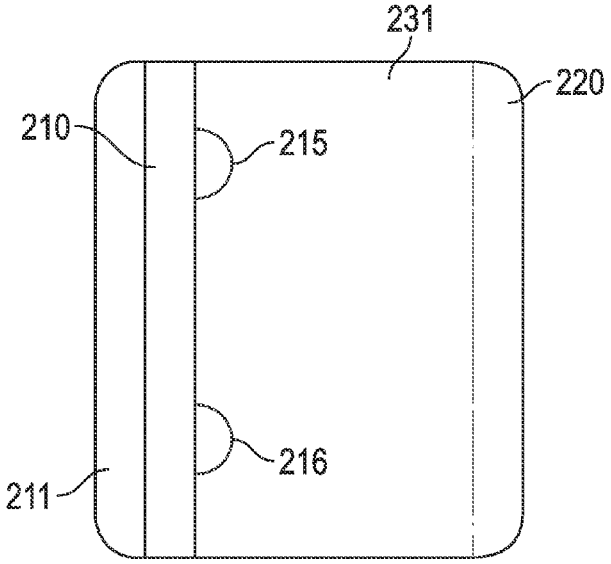
FIG. 2E shows the way the LEDs are mounted according to this embodiment.
Figure 2F:
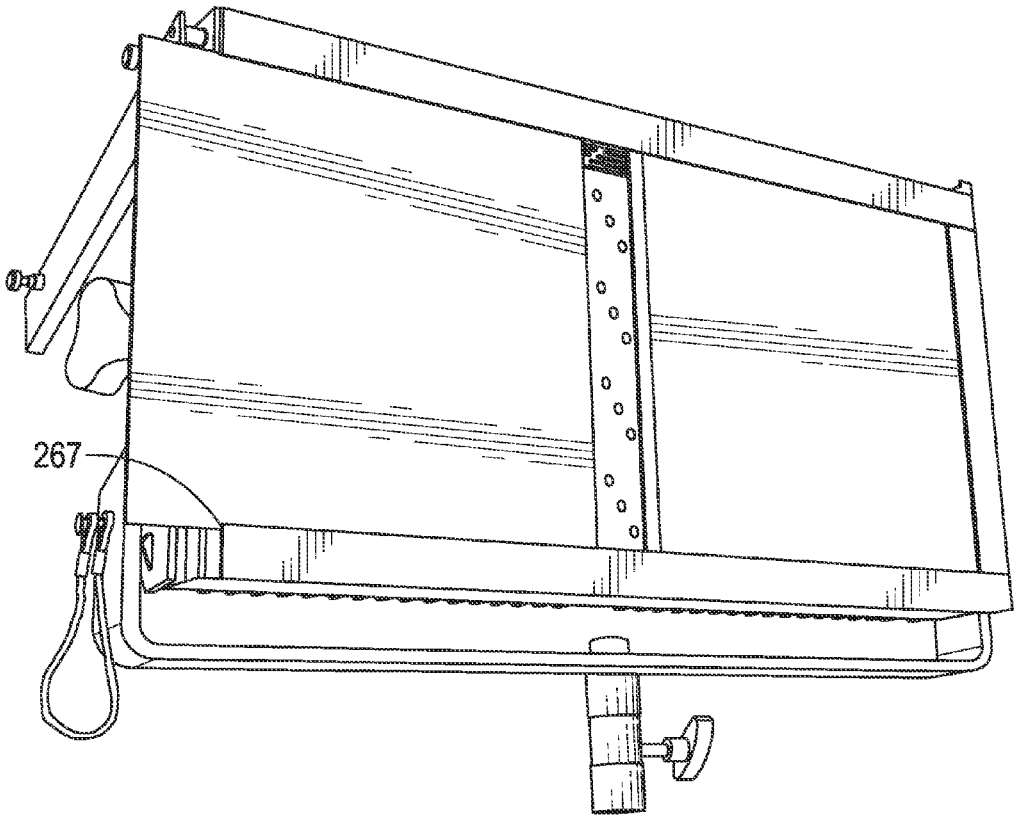
FIG. 2F shows the sliding portion.

FIGS. 2C and 2D show assembly drawings of the second embodiment, showing the light housing 200 being mounted on a movable bracket 250 that can be adjusted by tightening and loosening the knurled nut 231. FIG. 2D shows the assembly from the front, showing the bracket 250, knurled nut 231, and how the bracket extends around the housing.

In operation, the panels 220, 222 can also be changed, by first removing the panel removal screws 238, and then removing the panel retaining device 239. At this point, the panel retainer has been removed and the panels can be removed by sliding them along a slide holder 267 and replacing with another panel.

The light output can be characterized by determining the color rendering index or CRI, which measures the ability of the light source to reproduce certain colors. FIGS. 3A-3E shows the CRI measurements for these different phosphor panels according to the different embodiments.

FIG. 3A shows the CRI measurements for the different phosphor panels: for the 3200K light (the tungsten light), and for the 5200K light (the daylight version).

As shown, the 3200 K tungsten panel shown in FIG. 3A creates a composite CRI of 96, matching the different colors of the CRI spectrum by amounts exceeding 90 for all colors except for royal blue R12. Note however that this is done with an illumination of Royal blue, and thereby the illumination is believed to be distorting that specific output.

The general rendering color test for CRI is for the colors R1 through R8. For this general rendering color test, the value of the CRI was 96, but more generally any value greater than 95 or greater than 90 can be used for the extended CRI, that is the colors R9-R15, the CRI for the 3200 K unit was 95.

The daylight output (5200 K) model creates a CRI pattern exceeding 90 for all colors except R3, lime green, R6, baby blue, R9 red and R10 yellow and R12 royal blue. In so doing, this creates a basic CRI of 90, (average of R1-R7), with an extended CRI (average of R1 through R14) of 88 for the 5200K light. As can be seen, for the general CRI measurements, each of the values exceeds 88 and the CRI still exceeds 90 for the general values, while the extended CRI is 88.

See generally the description of the CRI given in CIE publication 13.3-1995.

Other measurements besides CRI can also be used to measure and/or evaluate the different color components of the phosphor-created light. In general, however, it is desirable for all the light components (for each of a plurality of colors/color temperatures) to have values that match the real world light by greater than 90%, or at least for 80% of those components to match the real world light components by 90% or greater.

Figure 3B:
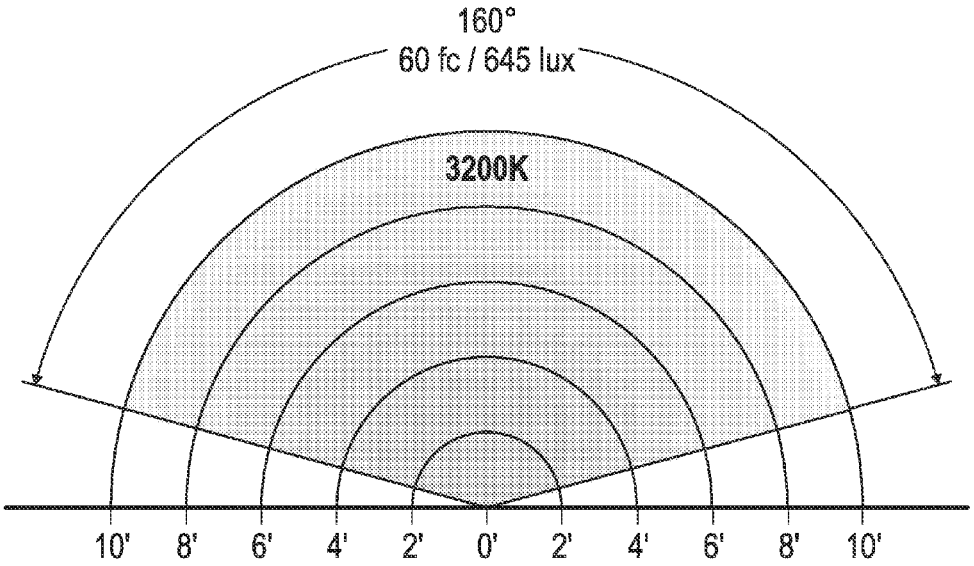
FIG. 3A shows CRI measurements according to an embodiment with FIGS. 3B and 3C respectively showing output characteristics for tungsten and daylight bulbs and FIGS. 3-D and 3E showing spectral output respectively for tungsten and daylight bulbs.
Figure 3C:
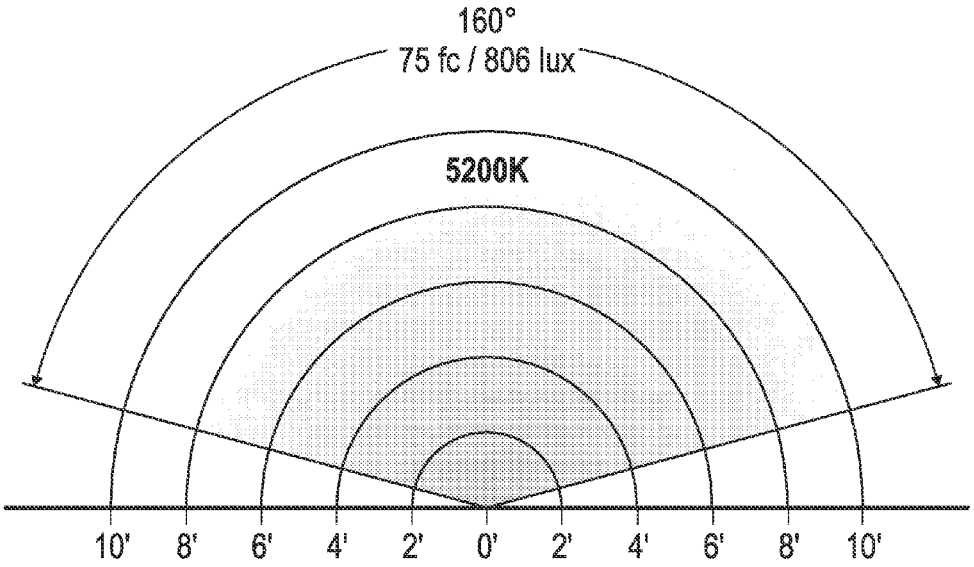

FIG. 3B shows the output characteristics of the light as a graph for the 3200 K light. Note that this output creates consistent light over 160°. At 10 feet, the output is shown as 645 lux and 60 footcandles. FIG. 3C shows the same values for the 5200 K light, at 10 feet the output 806 lux and 75 FC.

Figure 3D:
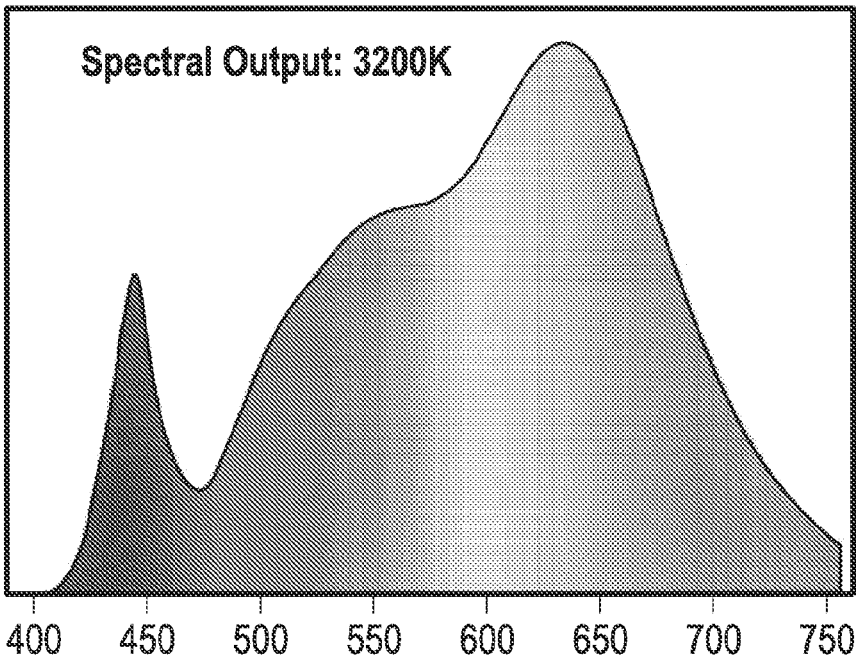

FIG. 3D shows the spectral output of the 3200 K light. The spectral output includes a peak at the royal blue area around 450 nm, attributable to the 450 nm light source which is used to excite the phosphors. The remaining part of the spectral output is relatively constant. In one embodiment, a 450 nm notch filter can be used to reduce the peak at the 450 nm area.

Figure 3E:
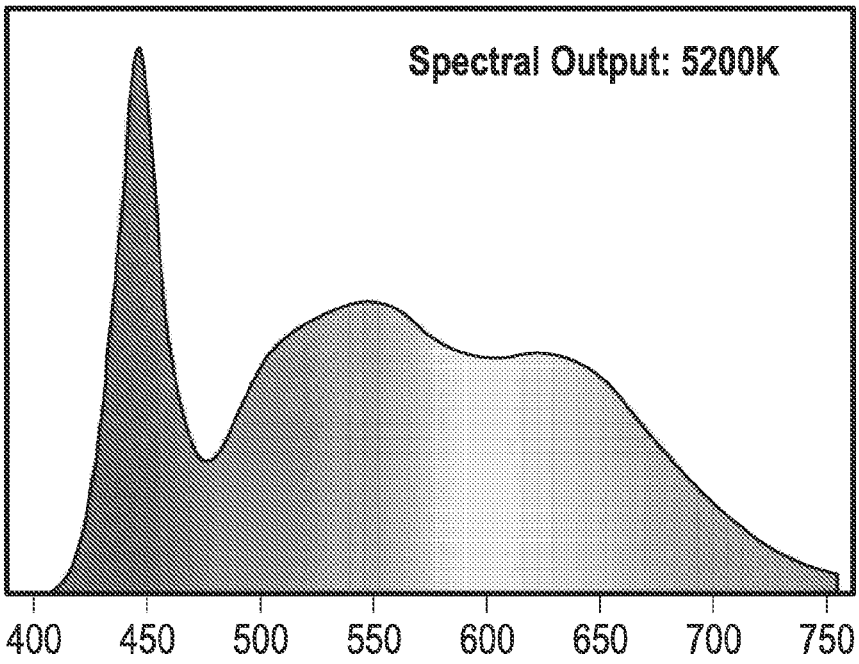

FIG. 3E shows the spectral output for the 5200 K light. Again, this includes spike at the 420 nm area, but otherwise relatively constant output.

Figure 4B:
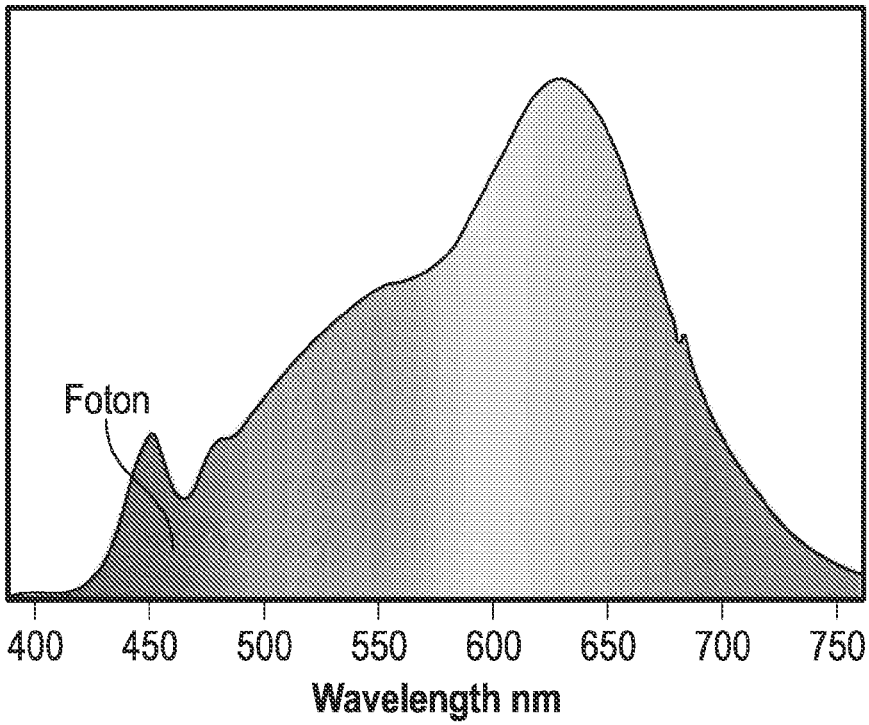
Figure 4B:
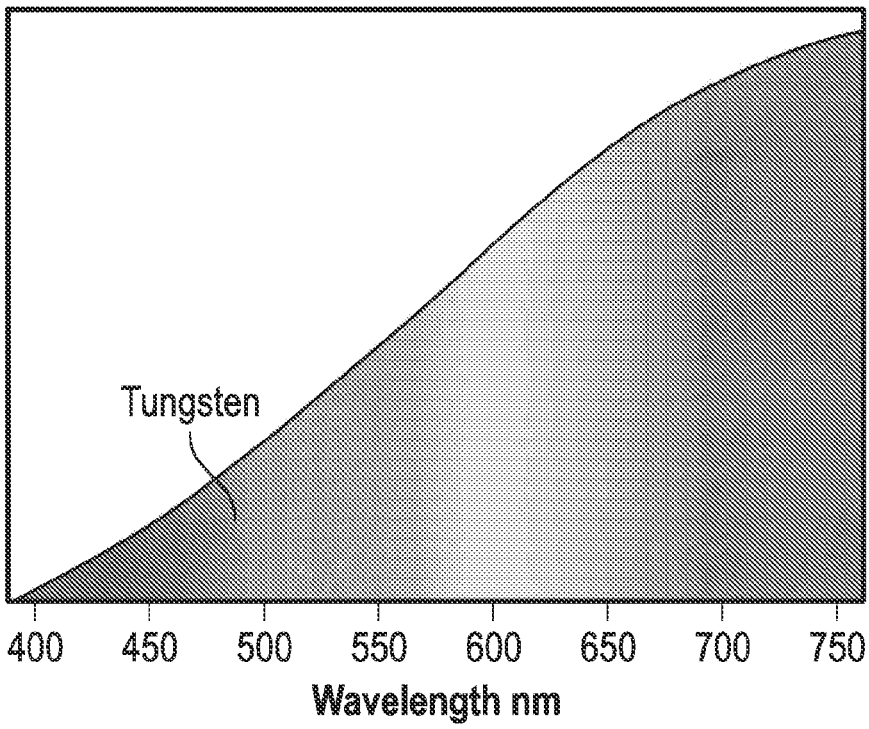

FIGS. 4A-4B show another embodiment, showing additional subject matter of the output of the remote phosphor as compared with a real tungsten bulb. FIG. 4A shows the CRI chart for this embodiment, as compared with a 'real' tungsten light source/bulb, showing how the CRI numbers are each within 10%, more preferably 5% or even more preferably 2% of the numbers of the real tungsten bulb.

FIG. 4B shows how the remote phosphor bulb approximates the operation of the real tungsten bulb, showing a very similar spectrum. In one embodiment, a notch filter is added at the blue end where the remote phosphor was actually excited. Note also, however, that towards the upper end of the spectrum, near the reds, the remote phosphor operation produces less red light. Importantly, however, the phosphor that is used attempts to match to a real world light source where each of a number of different color temperatures within the light source have different illumination amounts. Rather than attempting to match to a constant value at all colors, this system attempts to simulate the output of a real world lighting source by matching to that real world lighting source at multiple different components of the color.

Figure 5:
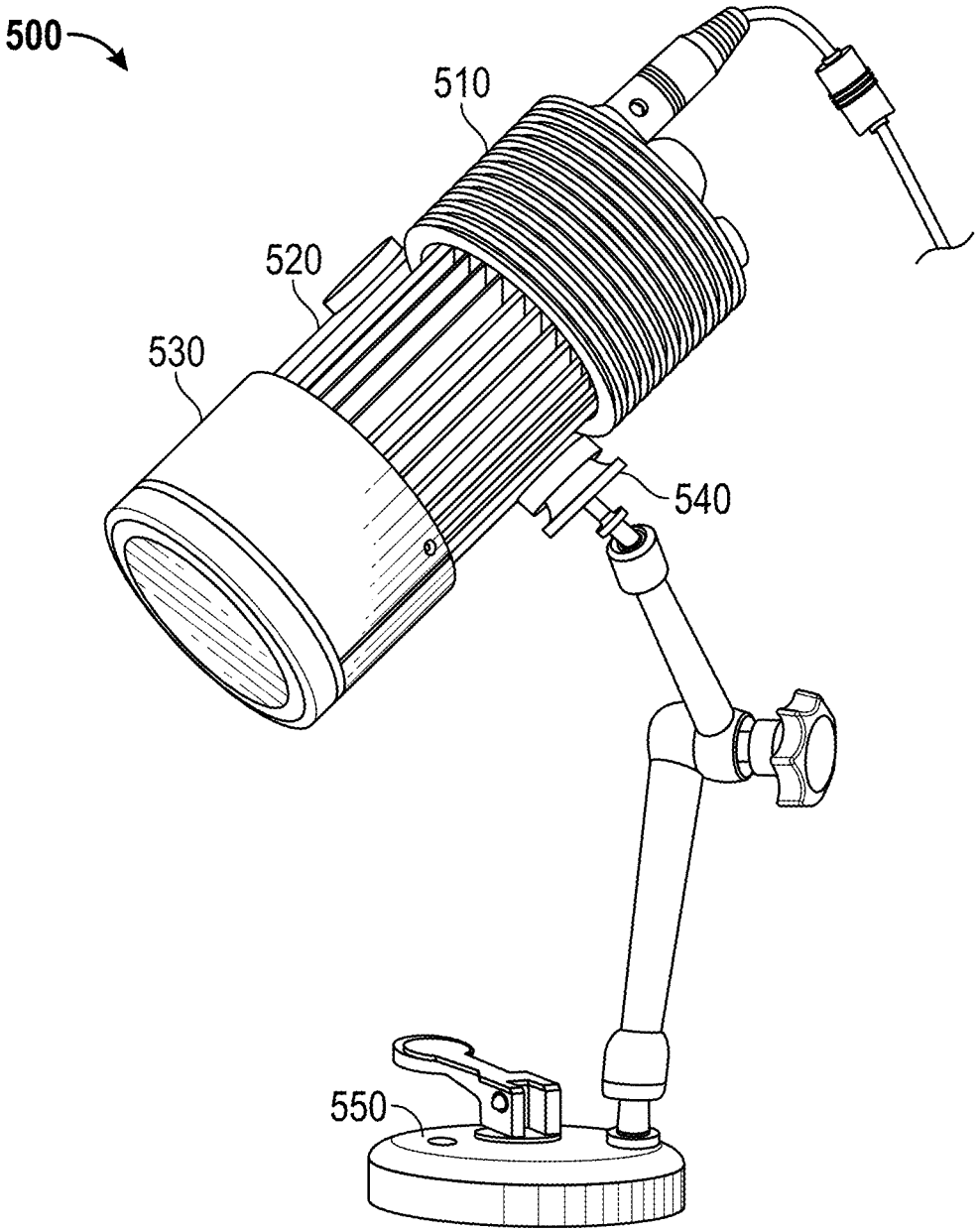
FIG. 5 shows another embodiment packaging.
Figure 6:
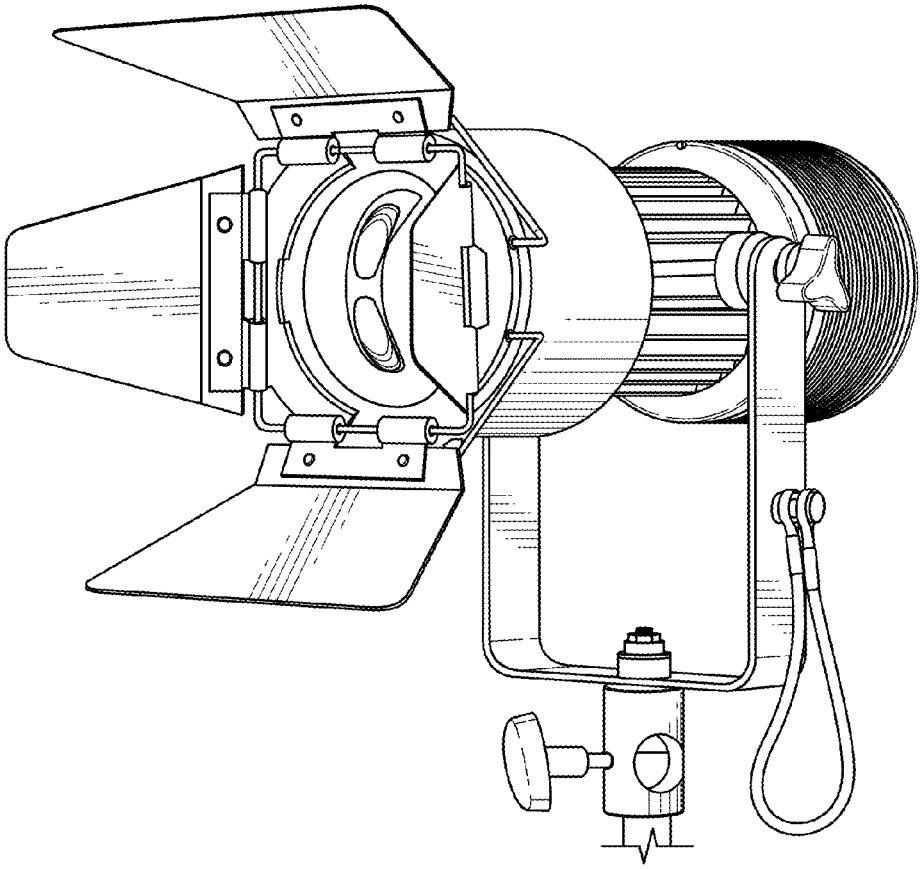
FIG. 6 shows an embodiment with a shutter.

FIG. 5 shows the housing of FIG. 1C in an alternative configuration. The housing 500 in FIG. 5 also includes an LED section 510, a mixing section with heat sink fins 520 and a lensing section 530. In this embodiment, the housing is held by a single knurled nut 540 on a platform mounted stand 550.

Figure 7:
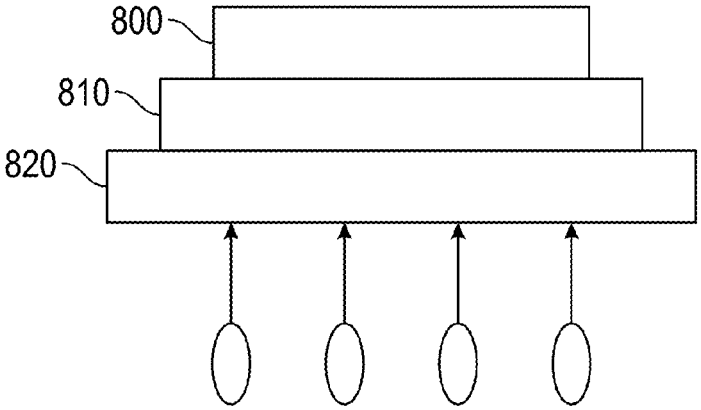
FIG. 7 shows an embodiment using a dichroic coating in addition to the phosphor coating.

Another embodiment addresses the "spike" of blue light that is observed in the spectrum of the remote phosphor light, as described above and shown in FIG. 3. This blue "spike" is believed created by the light that is itself created from the LED illumination. The embodiment of FIG. 7 shows using an alternative phosphor substrate in which an additional filter layer 800 is used as a 450 nm notch filter with a 50% attenuation, to remove the blue spike. The additional filter layer can be for example a dichroic layer configured as a notch filter. This is deposited directly on the phosphor coating 810 and that itself is on that is placed on the transparent structural panel 820. The phosphor coating still emits light, but this light is filtered by it the notch filter 800 that is set to notch out the blue light notch in the spectral output. For example, this may be an attenuator of 50% light around the 450 nm range, to attenuate by 50% the blue spike shown in the spectral output of FIG. 3.

Other notch filters as well as high pass filters and low pass filters can be used in this way to further adjust the output of the phosphor. For example, in the embodiment of FIG. 4A/4B, filters could be used to reduce most of the output other than that the red end of the range, to even further approximate the real world light source.

While the above describes making the notch filter from dichroic material, any optical notch filter can be used in this way. However, dichroic's have the special advantage in that the dichroic will bounce back some of the light to the light source, and the light source itself includes a reflector. The light in this way then bounces back to the dichroic, thus increasing the output of the light source in a similar way to a laser cavity.

Moreover, while the above describes the illuminating using blue LEDs, other colors of illumination can be used, and notch filters of the appropriate type can be used. For example, also, the notch filter can have multiple frequencies of attenuation.

According to another embodiment, the panels such as 220 in FIG. 2A can be formed of polycarbonate that has been coated in the way described above. The panels can be removed and replaced with different panels that have different lighting characteristics. This enables changing the characteristics of the lamp assembly by changing the polycarbonate panel.

In addition to the lighting systems discussed above, other simulated color devices can be created, including 2700K, 3200K, 4300K, 5600K, chroma green, and digital green screen. This can be used to change the CRI and CCT by changing the panel that is used.

Another embodiment can use a sliding panel which has different portions that have different photoreactive coatings. For example, strips of color can be used on the sliding panel, and the panel can be slid in order to put a different strip of color in the face of the lighting device. This can change the color output by sliding the material.

The above as described operation with only a few LEDs, however it should be understood that many LEDs can be used. In one embodiment, the photoreactive material phosphor may be excited by 120 blue LEDs.

In other embodiments, the photoreactive material can be excited by any other kind of energy, for example the photoreactive material can be excited by x-rays, or infrared, or by any other kind of energy. Any light producing device, such as a quantum dot could be used to create the output.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example, other formulations can be used and other LED emission spectra can be used.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments.

The lights which are described herein can be computer-controlled, and can be controlled for example over a network or DMX connection by sending remote controls over that connection. These lights can also, for example, the remotely controllable for pan and tilt.

Also, the inventor(s) intend that only those claims which use the words "means for" are intended to be interpreted under 35 USC 112, sixth paragraph. Moreover, no limitations from the specification are intended to be read into any claims, unless those limitations are expressly included in the claims.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A lighting device, comprising:

a housing;

a light source, held by the housing and emitting light;

a mixing chamber, formed within the housing, receiving the emitted light;

a substrate coated with a photoreactive material, held by the housing adjacent the mixing chamber and receiving the emitted light from the mixing chamber;

wherein the substrate is formulated to produce an output light when illuminated by the emitted light, where the output light as produced has multiple lighting components, each of the components representing a light output at a specific color temperature, and there being at least eight of said components in said output light, amounts of output light as produced at the components being different for at least a plurality of the components, and where the components which are not the same for the color temperatures each match within 80% of corresponding components at of a real world light source.

2. The lighting device as in claim 1, wherein the lighting device is remotely controllable over a remote control line.

3. The lighting device as in claim 1, wherein the real world light source is a tungsten light source and said components are color temperatures for the tungsten light source.

4. The Lighting device as in claim 1, wherein the real world light source is a daylight light source and said components are color temperatures for the daylight light source.

5. The lighting device as in claim 1, wherein the multiple lighting components are CRI color components.

6. The lighting device as in claim 1, wherein 80% of the different light components match within 90% of the components of the real world light source.

7. The lighting device as in claim 1, further comprising a lensing device, lensing the light output from the photoreactive coated substrate.

8. The lighting device as in claim 1, wherein the housing is rectangular in outer shape.

9. The lighting device as in claim 8, wherein the substrate is formed to be removable from the housing by sliding the substrate along slide surfaces in the housing.

10. The lighting device as in claim 9, wherein the substrate includes two separable substrates which are held adjacent to one another when in the housing.

11. The lighting device as in claim 1, wherein said light source emits light of a first color, where said first color is within one of said components, and further comprising a notch filter, which is configured to remove a part of said first color from an output light that is produced by the substrate.

12. The lighting device as in claim 11, wherein the notch filter is coated on the substrate, with the phosphor coating between a physical substrate and the notch filter.

13. The lighting device as in claim 11, wherein the notch filter is formed of a dichroic coating.

14. A lighting device, comprising:

a housing;

a light source, held by the housing and emitting light at a first color as emitted light;

a mixing chamber, formed within the housing, receiving the emitted light;

a phosphor coated substrate, removably held by the housing adjacent the mixing chamber and receiving the emitted light from the mixing chamber;

wherein the phosphor coated substrate produces an output light when illuminated by the emitted light; and a notch filter, which is configured to remove a part of light from the output light that is at the first color and outputting output light, which includes part of said first color, as a component thereof, where an amount of said first color is reduced by said notch filter.

15. The lighting device as in claim 14, where the output light as produced has multiple lighting components, each of the components representing a light output at a specific color temperature, and there being at least eight of said components, amounts of output light as produced at the components being different for at least a plurality of the components at different colors which are not the same for the different colors, and where the multiple lighting components which are not the same for the different colors each match within 80% of corresponding lighting components of a real world light source.

16. The lighting device as in claim 14, wherein the notch filter is coated on the substrate, with the phosphor coating between a physical substrate and the notch filter.

17. The lighting device as in claim 14, wherein the notch filter is formed of a dichroic coating.

18. A lighting device, comprising:

a housing;

a light source, held by the housing and emitting light;

a mixing chamber, formed within the housing, receiving the emitted light;

a first substrate coated with a photoreactive material, removably held by the housing adjacent the mixing chamber and receiving the emitted light from the mixing chamber, wherein the housing includes a slot along which the first substrate slides, wherein the first substrate produces an output light when illuminated by the emitted light, wherein the first substrate is slid along the slot in order to change characteristics of the emitted light, where said first substrate in a first location in the slot produces first characteristics and said first substrate in a second location in the slot produces second characteristics.

19. The lighting device as in claim 18, where the output light as produced has multiple lighting components, each of the components representing a light output at a specific color temperature, and there being at least eight of said components, amounts of output light as produced at the components being different for at least a plurality of the components, at different colors which are not the same for the different colors, and where the multiple lighting components which are not the same for the different colors each match within 80% of corresponding lighting components of a real world light source.

20. The lighting device as in claim 18, wherein the lighting device is remotely controllable over a remote control line.

* * * * *